United States Patent [19]

Blumenthal

[11] 4,455,781

[45] Jun. 26, 1984

[54] SORTING TOP

[76] Inventor: Martin Blumenthal, 99 Longview Ave., Chatham, N.J. 07928

[21] Appl. No.: 332,464

[22] Filed: Dec. 21, 1981

[51] Int. Cl.[3] ..... A63H 1/06

[52] U.S. Cl. ..... 446/241

[58] Field of Search ..... 46/64, 65, 66, 67, 68; 434/259

[56] References Cited

U.S. PATENT DOCUMENTS

| | | | |
|---|---|---|---|
| 1,985,716 | 12/1934 | Bueschel | 46/68 |
| 2,747,297 | 5/1956 | Zalkind | 434/259 |
| 3,230,662 | 1/1966 | Fuchs | 46/68 X |
| 3,500,556 | 3/1970 | Moskowitz | 434/259 |

FOREIGN PATENT DOCUMENTS

| | | | |
|---|---|---|---|
| 1113403 | 8/1961 | Fed. Rep. of Germany | 46/65 |
| 20102 | of 1907 | United Kingdom | 46/66 |

*Primary Examiner*—Mickey Yu

*Attorney, Agent, or Firm*—George E. Kersey

[57] ABSTRACT

A spinable hollow body with entry ports for receiving objects having prescribed configurations, including a base that is releasable by the spin generating mechanism in order to allow objects entered into selected entry ports to be released from the interior of the spinning body, which can therefore be considered to be a sorting top.

9 Claims, 3 Drawing Figures

SORTING TOP

BACKGROUND OF THE INVENTION

This invention relates to spinable hollow bodies that are known as hollow "tops" and, more particularly, to hollow tops which can be used in the sorting of objects entered into the top through external body orifices.

A common novelty for the amusement of children is the spinning top. It is sometimes of interest for a child to be able to insert items into the top. For that purpose the exterior surface of the top can include one or more entry orifices. After the entry of one or more objects into the top a rattling effect is created that can be the source of amusement and interest for the child user.

Once objects are inserted into the top, however, a convenient mechanism must be provided for release of the objects. It is of further interest to the child user to be able to release the objects while the top is in motion.

Accordingly, it is object of the invention to achieve a novel configuration for a spinning body, particularly a spinning top.

Another object of the invention is to adapt the top for receiving prescribed objects in its interior while the top is in motion.

Another object of the invention is to permit the release of objects inserted into a hollow, spinning top while the top is in motion.

SUMMARY OF THE INVENTION

In accomplishing the foregoing and related objects, the invention provides a spinable hollow body that is operable by a plunger that is depressable into the body, which has a closure that is separately operable by the depression of the plunger into the base.

In accordance with one aspect of the invention, the body includes entry orifices having prescribed configurations to permit the spinable body to be used in the sorting of objects entered into the body through the entry orifices.

In accordance with another aspect of the invention, the spinable body is supported by a base which includes a collar into which the plunger is depressable, and the closure for the body is slidably movable along the collar as the plunger is depressed. The plunger desirably is in the form of a helix that can be structured from an elongated strip of material which is bendable into a spiral configuration.

In accordance with a further aspect of the invention, the plunger is secured to a spring loaded member in the base. The spring loading desirably is effected by a coil spring within a cylindrical collar into which the plunger in inserted. The spinable body advantageously contains a clutch which surrounds the plunger and is acted upon by it. For that purpose, the hollow body can be a cylindrical shell with a central hub that contains the clutch in an opening which receives the plunger.

In accordance with still another aspect of the invention the plunger controllable closure of the hollow, spinable body constitutes a conical depression into the body and permits sortable objects entered into orifices of the body to slide from the interior of the body over a conical closure surface when the closure is acted upon by the plunger. The degree of opening of the closure is controlled by the extent to which the plunger is depressed into the body.

DESCRIPTION OF THE DRAWINGS

Other aspects of the invention will become apparent after considering several illustrative embodiments taken in conjunction with the drawings in which.

DETAILED DESCRIPTION

Figure 1:
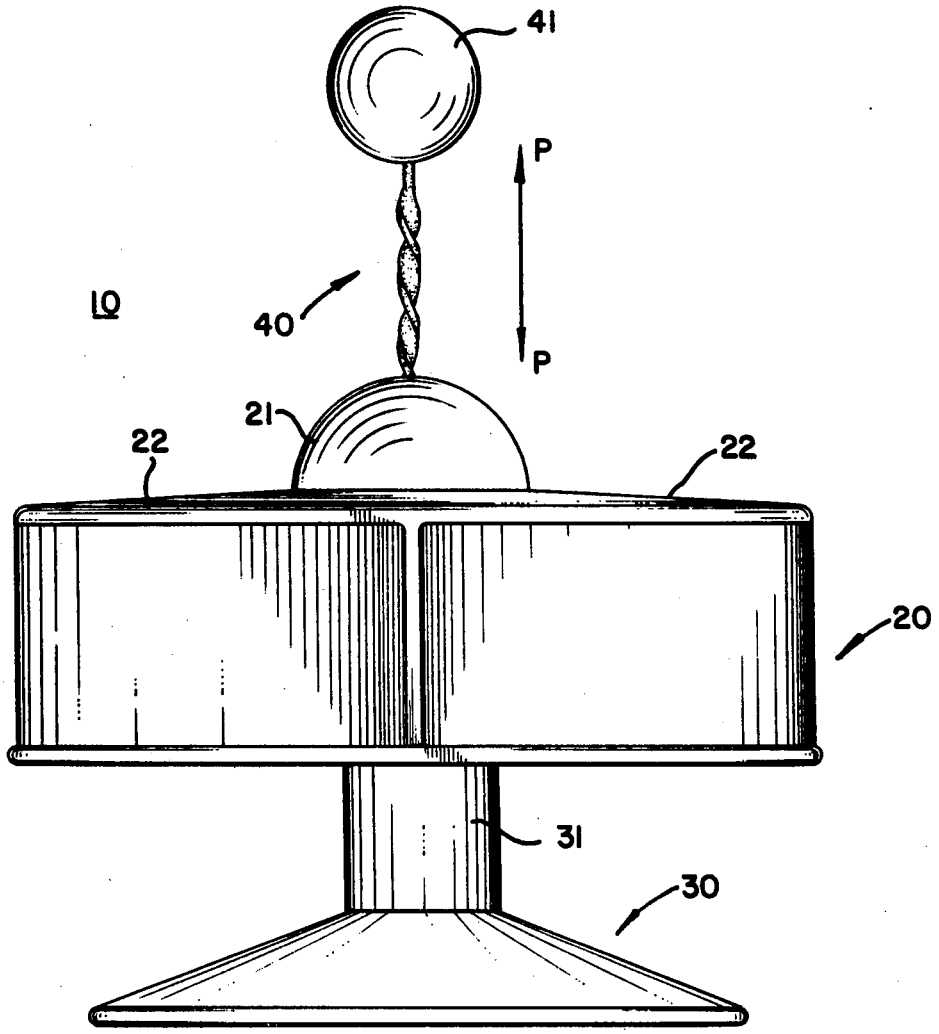
FIG. 1 is a side view of a sorting top in accordance with the invention.

With reference to FIG. 1, a sorting top 10 in accordance with the invention includes a spinable body 20 that is supported on an upstanding collar 31 of a base 30.

The body 20 is set into rotation as indicated by the arrow R by pumping a plunger 40, indicated by a double-headed arrow P, through a dome 21 of the body 20. To facilitate the pumping operation, the free end of the plunger 40 includes a knob 41.

Figure 2:
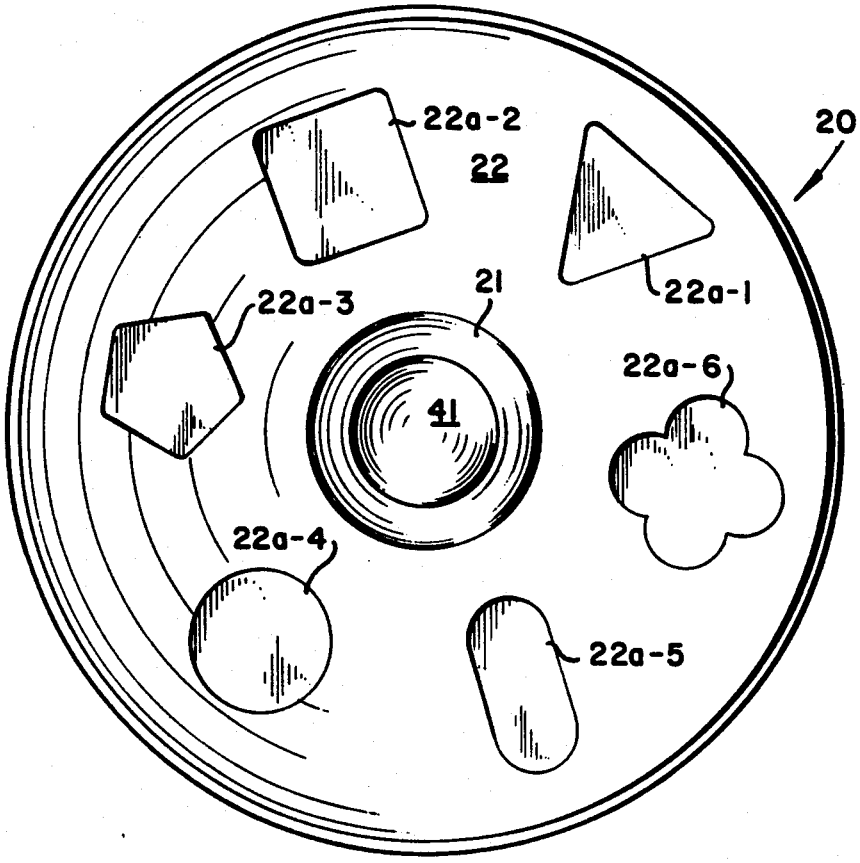
FIG. 2 is a top view of the sorting top of FIG. 1.

As indicated more clearly in FIG. 2, the top surface 22 of the body 20 includes a set of apertures **22*a*-1 through 22*a*-6. These apertures allow objects to be inserted into the body 20**, either before or during rotation in the direction indicated by the arrow R. It will be noted that the apertures accommodate pieces of different sizes and configurations, presenting a challenge to the user in inserting the correct object into the corresponding aperture.

Figure 3:
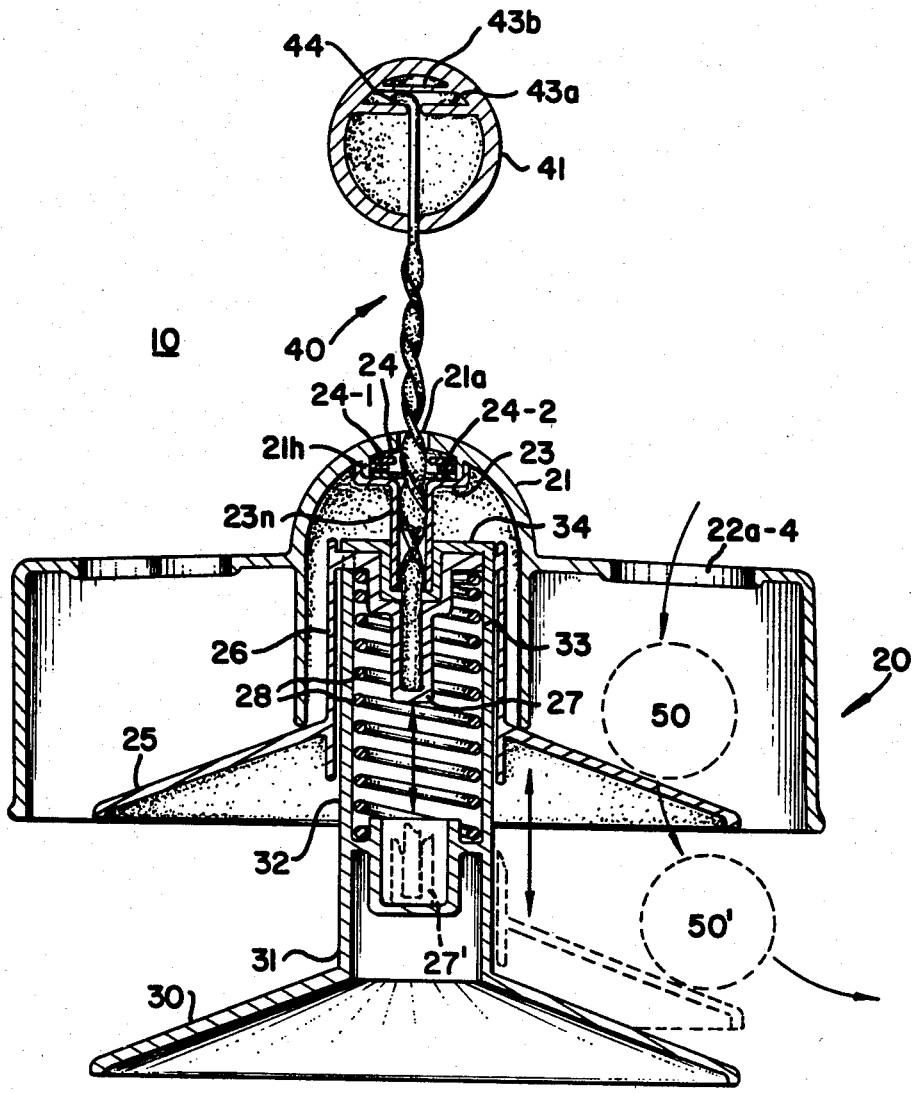
FIG. 3 is a sectional view of internal mechanism of the top of FIGS. 1 and 2.

The mechanism for the top 10 is illustrated in FIG. 3. The body 20 is supported at its dome 21 by a bearing 23 which has an upper cup that is press-fit into a dome housing **21*h* that contains a clutch 24. The bearing 23 is rotationally positioned in a cup 34 of a cylindrical extension 33 that extends from the collar 31 by an intervening neck 32**.

The plunger 40 extends into the dome 21 through an aperture **21*a*, and then through the clutch 24 into the neck 23*n* of the bearing 23. The end of the plunger 40 is press-fit into an actuator cup 27 within the cylindrical extension 33 of the collar 31. The cup 27 is in engagement with a base closure 25 through a cylinder 26. The latter includes prongs 26*p* that move in a slot 33*s* of the base extension 33**.

The movable closure 25 is held in its upper equillibrium position as shown in FIG. 3 by a coil spring 28. As the plunger 40 is depressed, the receiving cup 27 moves downwardly, exerting a downward force on the closure cylinder 26.

The clutch 24 in the dome 21 is formed by two cylindrical disks 24-1 and 24-2. When the plunger 40 is moved downwardly, the upper disk 24-1 is brought into contact with the lower disk 24-2. Further depression produces the rotation symbolized by the arrow R in FIGS 1 and 2. There is no rotational movement resulting from the withdrawal of the plunger 40 through the dome 21, since the withdrawal motion brings about separation of the clutch disks 24-1 and 24-2.

The free end of the plunger 40 terminates in a knob 41 into which the plunger strip is inserted after being formed into a bend tip 44, which is held between the ledges **43*a* and 43*b* of the knob 41. The knob 41** is advantageously formed by two hemispheres which are adhesively secured to one another.

The plunger 40 is a helical strip formed by twisting an elongated rectangular member. The outer edge of the helix acts upon the clutch disk 24-1 to move it into contact with the lower disk 24-2.

In one embodiment of the invention the helix is a flat nickel plated steel strip having a thickness of 0.080 inches and a 7/32 inch wide edge. The clutch disks 24-1 and 24-2 are nickel plated steel sheets with a thickness of 0.062 inches. The spring 28 is 1.037 inches in diameter made from music wire with an outside diameter of 0.037 inches and 12 zinc plated coils, with closed ends. The cup 27 that receives the end of the plunger 40 is of high density polyethylene. The remaining parts are of high impact polystyrene.

It is to be noted that the extension of the collar 31 into the body 20 is in two parts 32 and 33 to facilitate assembly. The parts are assembled into the extension 33 and then sonically bonded to the lower neck 32.

In operation the top 10 is set in motion by partial pumping of the plunger 40. Objects are inserted through the body apertures and are released according to the extent to which the plunger is depressed into the collar 31. Illustratively, a sphere 50 is shown in phantom within the body 20 after having been inserted into the corresponding aperture **22*a*-4. When the plunger is depressed sufficiently to allow clearance between the closure 25 and the lower edge of the body 20 the inserted object is discharged. In FIG. 3 the closure 25 is shown in phantom fully depressed with the cup 27' in contact with the cup of the neck 31 and the sphere 50' in position for rolling outwardly on the conical apron of the closure 25**. As noted above, the internal objects are variously released without full depression of the plunger according to their sizes.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A toy with a spinable hollow body comprising a base, a plunger mounted on said base and depressable into said base, a hollow body portion supported by said base for spinning movement relative thereto, cooperating means on said plunger and body portion whereby the latter is spinable by the depression of said plunger into said base, and a closure for said body portion mounted on said base and movable from a position closing said body portion to a position opening said body portion, means for normally maintaining said closure in said closing position, said closure being openable by the depression of said plunger into said base, wherein said base includes a collar into which said plunger is depressable and said closure is slidably movable along said collar.

2. Apparatus as defined in claim 1 wherein said body portion includes entry orifices having prescribed configurations; thereby to permit said spinable body to be used in the sorting of objects entered into said body portion through said entry orifices.

3. Apparatus as defined in claim 1 wherein said plunger is a spiral helix.

4. Apparatus as defined in claim 3 wherein said spiral helix is formed from an elongated strip of material which is bendable into a spiral helix.

5. Apparatus as defined in claim 1 wherein said plunger is secured to a spring loaded member in said base.

6. Apparatus as defined in claim 5 wherein the spring loaded member is a coil spring within a cylindrical collar into which said plunger is inserted.

7. Apparatus as defined in claim 1 wherein said spinable hollow body contains a clutch which surrounds said plunger and is acted upon thereby.

8. Apparatus as defined in claim 1 wherein said hollow body is a cylindrical shell with a central hub containing a clutch and an opening for receiving said plunger.

9. Apparatus as defined in claim 8 wherein said closure constitutes a conical depression into said body portion and permits sortable objects entered into orifices of said body portion to slide from the interior of said body portion over the conical surface of said closure when acted upon by said plunger.

* * * * *